US006807755B2

(12) United States Patent
Bontems et al.

(10) Patent No.: US 6,807,755 B2
(45) Date of Patent: Oct. 26, 2004

(54) IRON COMPRISING A WATER FILLING SLIDE VALVE

(75) Inventors: Cédric Bontems, Villeurbanne (FR); Gérald Latout, Eyzin-Pinet (FR); Eric Mathieu, Vienne (FR); Matthias Hahn, Frankfurt (DE)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 10/474,146

(22) PCT Filed: Jan. 30, 2003

(86) PCT No.: PCT/FR03/00276

§ 371 (c)(1),
(2), (4) Date: Oct. 6, 2003

(87) PCT Pub. No.: WO03/066954

PCT Pub. Date: Aug. 14, 2003

(65) Prior Publication Data

US 2004/0128871 A1 Jul. 8, 2004

(30) Foreign Application Priority Data

Feb. 6, 2002 (FR) ..... 02 01404

(51) Int. Cl.[7] ..... D06F 75/14
(52) U.S. Cl. ..... 38/77.8
(58) Field of Search ..... 38/77.1–77.5, 38/77.8, 77.81, 77.82, 88; 251/84, 118, 149.1, 284, 319, 368; 141/18, 331, 391

(56) References Cited

U.S. PATENT DOCUMENTS

| | | | | | |
|---|---|---|---|---|---|
| 2,802,288 | A | * | 8/1957 | Hoecker | 38/77.5 |
| 2,811,793 | A | * | 11/1957 | Humphrey et al. | 38/77.7 |
| 2,817,912 | A | * | 12/1957 | Schott et al. | 38/77.83 |
| 2,861,365 | A | * | 11/1958 | Block | 38/77.82 |
| 4,233,763 | A | * | 11/1980 | McMullen | 38/77.83 |
| 4,748,755 | A | * | 6/1988 | Bain et al. | 38/88 |
| 6,243,976 | B1 | * | 6/2001 | Beverly et al. | 38/77.5 |
| 6,625,910 | B2 | * | 9/2003 | Ching et al. | 38/77.3 |

FOREIGN PATENT DOCUMENTS

| | | |
|---|---|---|
| DE | 100 15 078 | 10/2001 |
| FR | 2 677 674 | 12/1992 |
| JP | 59 162000 | 8/1984 |
| JP | 59 155296 | 9/1984 |
| JP | 61 164598 | 7/1986 |

* cited by examiner

*Primary Examiner*—Ismael Izaguirre
(74) *Attorney, Agent, or Firm*—Browdy and Neimark, P.L.L.C.

(57) ABSTRACT

The invention relates to an iron. The inventive iron consists of a liquid container (6) comprising an inlet (7) which is fitted with means of receiving and guiding the liquid through said opening towards the container. Preferably, the aforementioned means comprise a part (9) in the form of a slide valve or chute. Moreover, said means, which pass through the opening, can move in translation between a first open position, whereby the liquid can be introduced, and a second closed position, whereby the means are retracted into the iron in order to close the opening (7).

12 Claims, 6 Drawing Sheets

IRON COMPRISING A WATER FILLING SLIDE VALVE

The present invention concerns a pressing iron having a liquid reservoir.

The reservoir is generally a water reservoir used to contain water to be vaporized.

There are known irons that are equipped with a water reservoir having a large orifice permitting a user to fill it. This orifice is usually disposed at the front of the iron so that the liquid does not flow out when the iron is placed on its heel.

But during ironing movements, water in the reservoir is agitated and could exit through the filling opening if measures were not taken to avoid or limit this drawback For this reason, filling openings having large dimensions are completed by baffles as explained in the patent FR 2677674, or are closed by a large moveable shutter pivotable or sliding such as described in the patent DE 10015078. However, baffles limit the flow rate of water, movable shutters occupy a substantial space on the iron in the extension of the handle. In many cases, the oblique position of the orifice does not allow the iron to be filled in the vertical position and requires controlling the stoppage of steaming. In addition, the other organs, such as the sprayer, the controls for the drip device, surge steam and others present technical or ergonomic positioning constraints that do not leave the possibility for optimizing the dimensions of the filling orifice. Because of this obstacle, in the known configurations, the filling orifice is in the end is reduced and does not permit an easy and rapid filling of the iron.

The invention that follows remedies these drawbacks.

The goal of the invention is achieved by a pressing iron, composed of a liquid reservoir having a filling orifice, by the fact that this orifice is furnished with means for receiving and guiding the liquid through the orifice toward the reservoir, said means passing through the orifice and being movable in translation between a first open position where the liquid can be introduced and a second closed position where said means are retracted into the iron and assure closing of the orifice.

The means for receiving the liquid being retractable, they can be larger than the orifice which no longer has to be aimed at with precision during filling of the iron by the user.

The liquid being guided, the orifice can be small and consequently be disposed in a better manner to supply the reservoir, without the organs such as the controls for the drip device, the pump, the surge steam, etc. being flooded during filling.

Preferably, the means for receiving and guiding the liquid comprise an elongated slide valve, having an opening on one longitudinal face to receive the liquid, and open at its inner end to permit flow of the liquid.

By elongated slide valve or chute there is intended a hollow piece formed of two longitudinal faces, a bottom adjacent to these two faces, and a flat outer end face, the remaining longitudinal face having an opening for receiving the liquid. This opening can constitute all or part of the remaining longitudinal face.

Then, the face for receiving water has a large longitudinal opening, so that the liquid inlet can be of large cross-section, which facilitates filling. The construction of these means is as economical as that of a lid for closing the orifice since it does not increase the number of parts of the iron.

Moreover, the slide valve can have a flared transverse cross-section comparable to a funnel.

Preferably, the elongated slide valve has a transverse cross section corresponding substantially to the filling orifice, and is permanently engaged to slide in said orifice, the internal open end being directed toward the reservoir.

The elongated slide valve remains constantly engaged in the orifice and can slide between the first open position and the second closed position. In the closed position, the elongated slide valve is thus retracted into the interior of the reservoir. Simple structural arrangements, on the one hand prevent undesired extraction of the slide valve out of the orifice, and on the other hand permit it to be maintained in the closed position.

Usefully, a joint assures sealing between the elongated slide valve and the filling orifice.

According to a first embodiment, the slide valve is arranged in the iron in such a manner that, when the iron is placed on its heel, the opening of the slide valve is oriented toward the top.

The iron being on its heel, the elongated slide valve being pulled toward the outside of the iron, the iron can be filled conveniently with water poured into the large opening.

Preferably in this position, the slide valve remains slightly inclined with respect to the horizontal, to facilitate a natural flow of water toward the interior of the reservoir.

Preferably, in the second closed position, the opening is completely retracted into the reservoir.

The opening only occupies a part of the corresponding face of the elongated slide valve. As a result, in the second closed position, the joint that surrounds the filling orifice bears on solid parts of the elongated slide valve and fully assures sealing.

Preferably, the outer end face, closing the orifice in the second closed position, has means for maneuvering the elongated slide valve.

Shapes carried by the outer end face permit the elongated slide valve to be gripped during manual opening and closing.

Preferably, in said second closed position, utilized during ironing, the iron being on its working surface, the slide valve is immersed in the water of the reservoir, and as a result brakes the movements of water in the reservoir, constituting a wave preventing device.

In another embodiment, the means for receiving and guiding liquid comprise a U-shaped piece constituting three lateral faces of an elongated slide valve at least partially without a bottom, the fourth lateral face being an inner end open in to the reservoir.

When the slide valve is in the second closed position, retracted into the iron, it obstructs the interior less and allows passage between the branches of the U to the organs of the iron, for example control rods.

Advantageously, the elongated slide valve slides on a solid part of the iron which constitutes a fixed bottom for the movable slide valve.

There are thus found advantages similar to those of the preceding version.

Usefully, the piece in the form of a U of the slide valve has a lip assuring a basic sealing with the fixed bottom.

Preferably, the piece in the form of a U is made of elastomer and forms a single piece with the joints assuring sealing with the fixed bottom and closing the orifice.

The invention will be better understood in view of the examples hereafter and the associated drawings.

Figure 1:
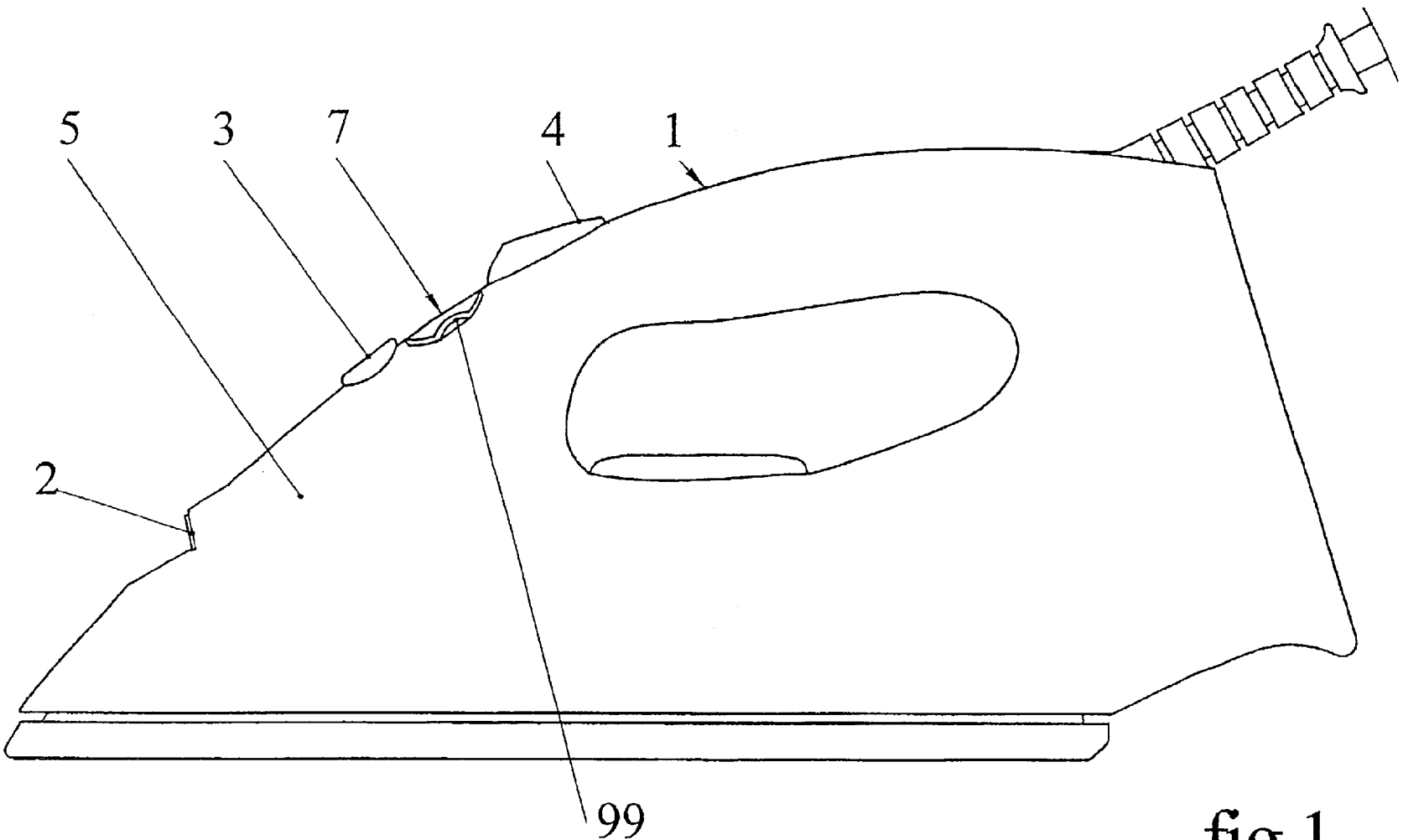
FIG. 1 is a side view of a pressing iron according to a first version of the invention.
Figure 2:
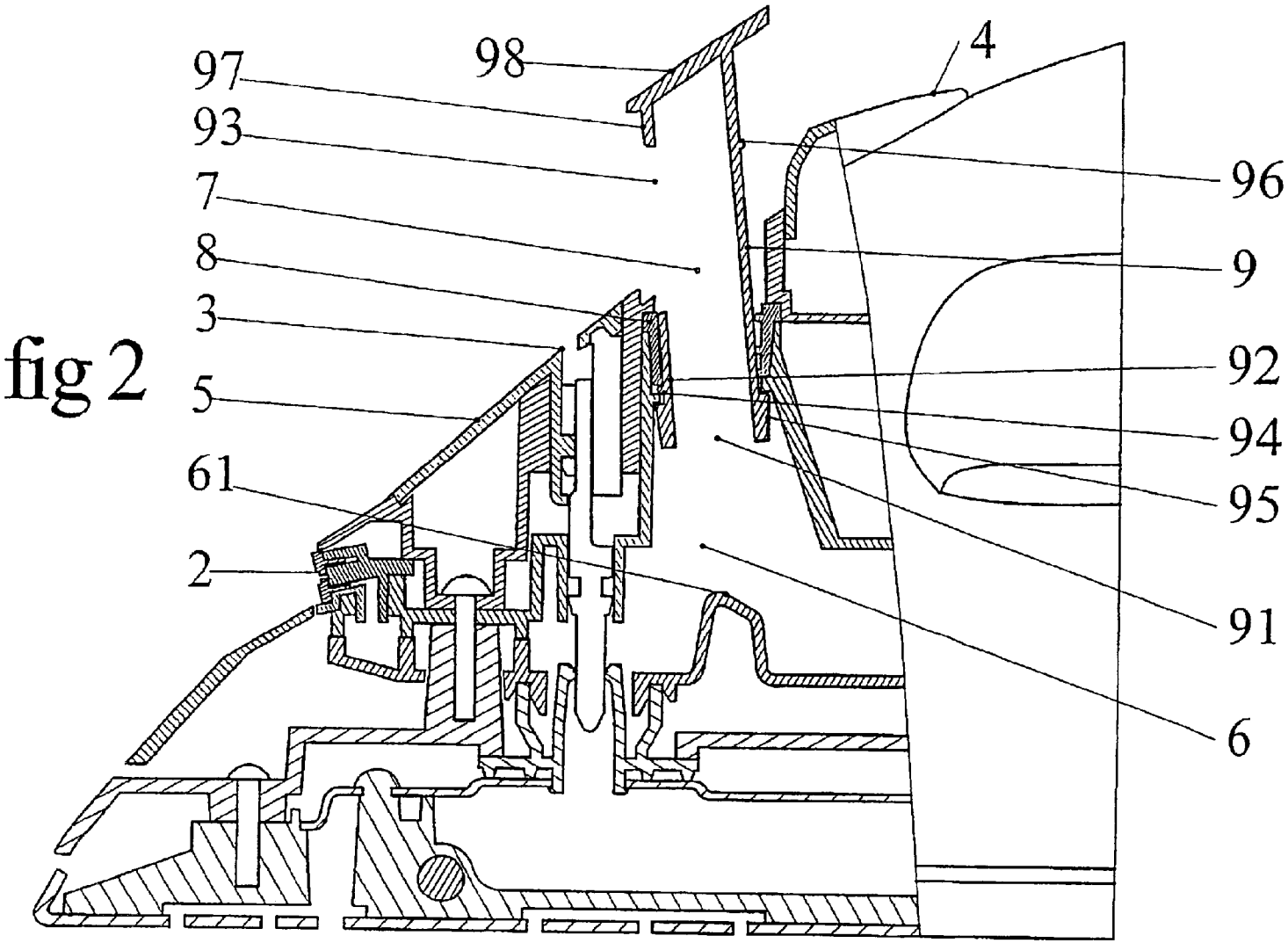
FIG. 2 is a view of the front of the iron of FIG. 1, in partial cross-section through a longitudinal plane, the means for receiving and guiding the liquid being in a first open position.
Figure 3:
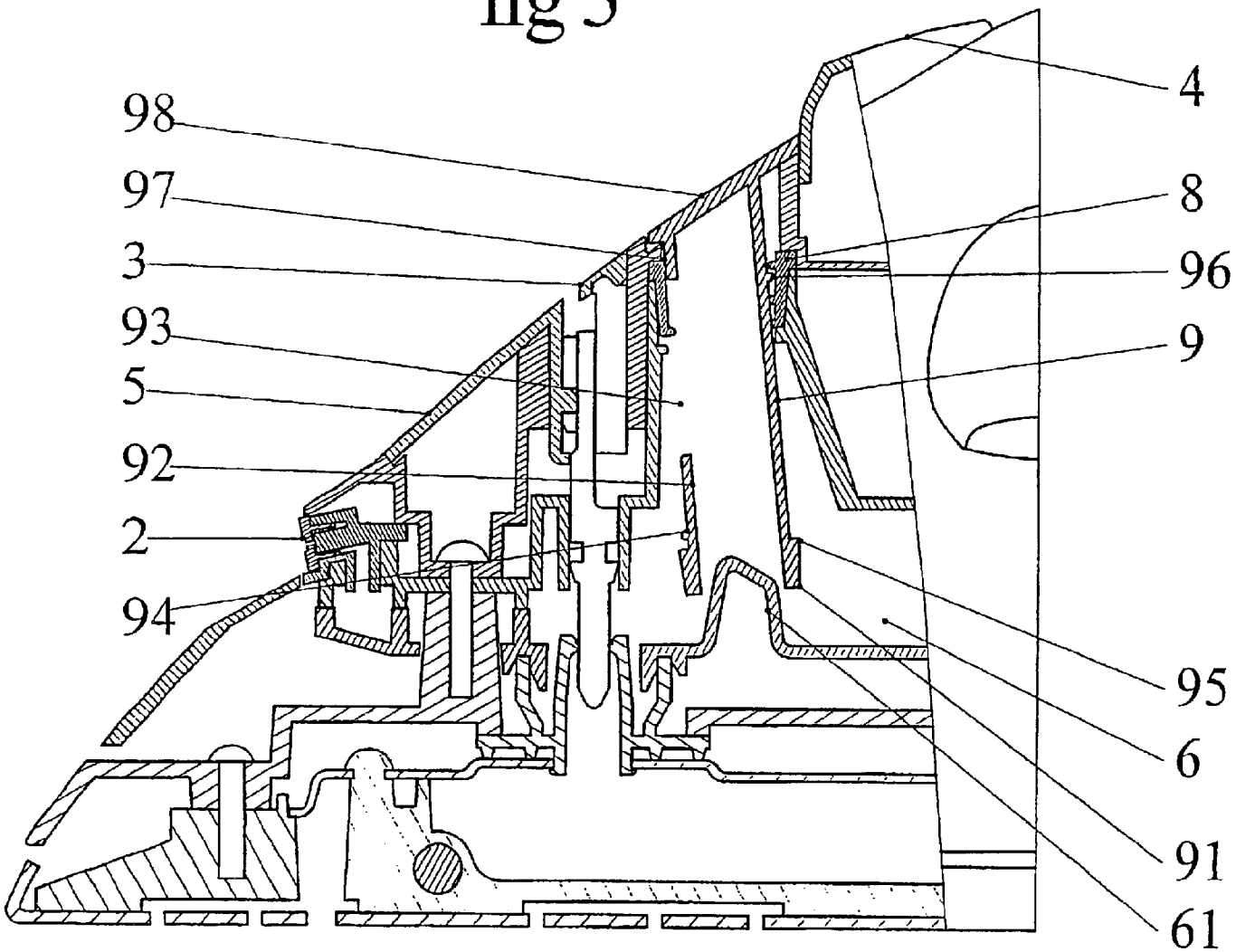
FIG. 3 is a view of the front of the iron of FIG. 1, in partial cross-section through a longitudinal plane, the means for receiving and guiding the liquid being in a second closed position.

In a preferred version visible in FIGS. 1 to 3, a steam iron 1 has a sprayer 2, a drip control 3, and steam and spray control 4, grouped on body 5 at the front of the iron.

Iron 1 has a water reservoir 6 visible in FIGS. 2 and 3 of which the filling orifice 7 is situated toward the front and at the top of the iron in proximity to the previously cited organs.

Orifice 7 is furnished with a sealing joint 8 in which slides an elongated piece in the form of a slide valve or chute 9, occupying the entire cross-section of orifice 7. One end face 91 of slide valve 9 is open at the interior of the reservoir. One longitudinal face 92 of the slide valve has an opening 93, larger than orifice 7, directed toward the front of the iron in a manner such that it is found to be oriented upwardly when the iron is placed on its heel.

Slide valve 9 is retained in a first open position, represented in FIG. 2, by an elastic lock 94 and forms 95 preventing its accidental extraction from the iron. In this position, opening 93 is accessible from outside the iron. A passage is provided from the outside of the iron toward reservoir 6 through opening 93, slide valve 9 and end face 91.

Slide valve 9 can slide along a longitudinal axis in orifice 7 between the open position and a second closed position visible in FIG. 3. It is maintained in this second position by an elastic lock 96. In this position, joint 8 rests on a solid part 97 of wall 92 and assures complete sealing between slide valve 9 and reservoir 6. The solid wall of end 98 of slide valve 9 then assures closing of orifice 7.

In this closed position, slide valve 9 plunges into the reservoir, into the water that it can contain. A form 61, of the bottom of reservoir 6, close to inner end 91 prevents agitated water from surging into the slide valve during ironing.

Advantageously, this wall 98 carries forms 99 visible in FIG. 1 that permit gripping of slide valve 9 by the user, and its displacement from one position to the other.

During ironing, iron 1 is used with slide valve 9 retracted into reservoir 6, immobilized by a lock 96 in the position shown in FIGS. 1 and 3. Water contained in the reservoir cannot exit and splash through the hermetically closed orifice 7. A small vent not shown is provided between the reservoir and the atmosphere to prevent creation of a low pressure in the reservoir. This small vent can be a small calibrated hole disposed toward the front of the iron on the end wall 98.

When the user wants to fill reservoir 6, she places the iron on its heel and pulls slide valve 9 to place it in the filling position. The drip device, situated at the front of the reservoir when the iron is flat, can no longer be supplied. The slide valve is retained by forms 95. This facilitates usage of the slide valve, the user only having to pull the slide valve until it arrives in abutment and is immobilized by lock 94. Opening 93 is then accessible from above and can receive the filling water supplied for example from a cup or by a stream of water from a faucet.

The water flows from opening 93 along slide valve 9 and through orifice 7 and leaves the slide valve by its open inner face 91 from which it fills reservoir 6. Opening 93 has a larger cross-section than the cross section of orifice 7, which facilitates filling and permits, upon construction of the iron, reducing the space occupied by this orifice. By this fact, the orifice can be disposed toward the top of the iron without interfering with the other controls.

In a second version visible in FIGS. 4 to 7, a steam iron 100 has a control acting by the intermediary of a rod 300 on a drip device.

Figure 7:
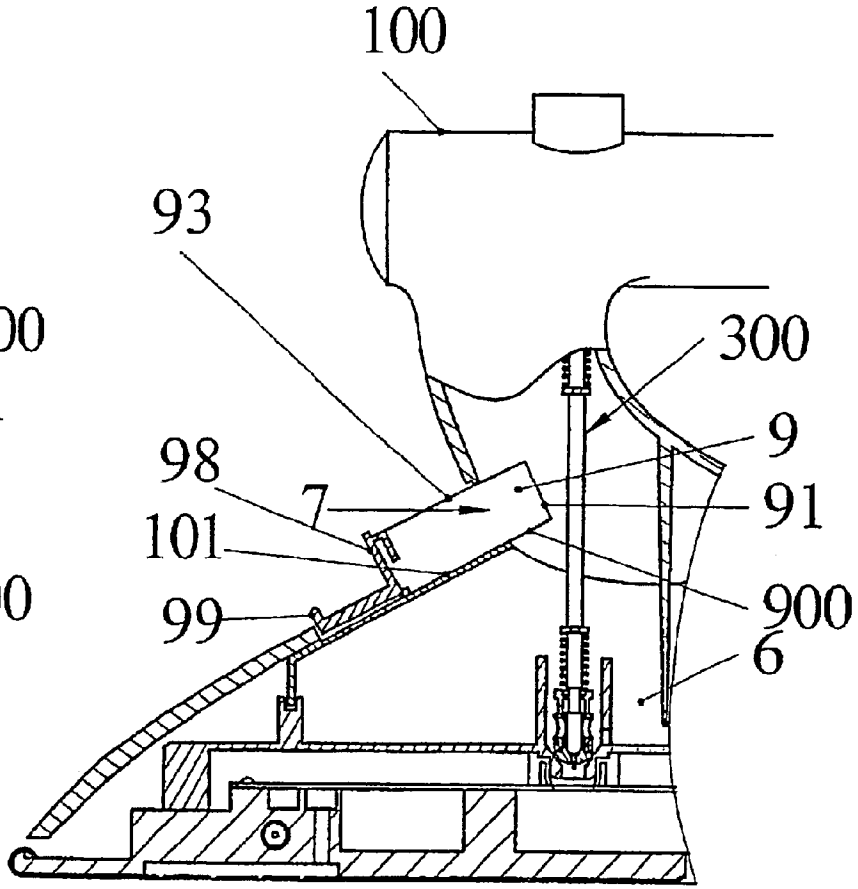
FIG. 7 is a partial view in partial cross-section through a longitudinal plane of the iron of FIG. 4, the means for receiving and guiding the liquid being in a first open position.
Figure 6:
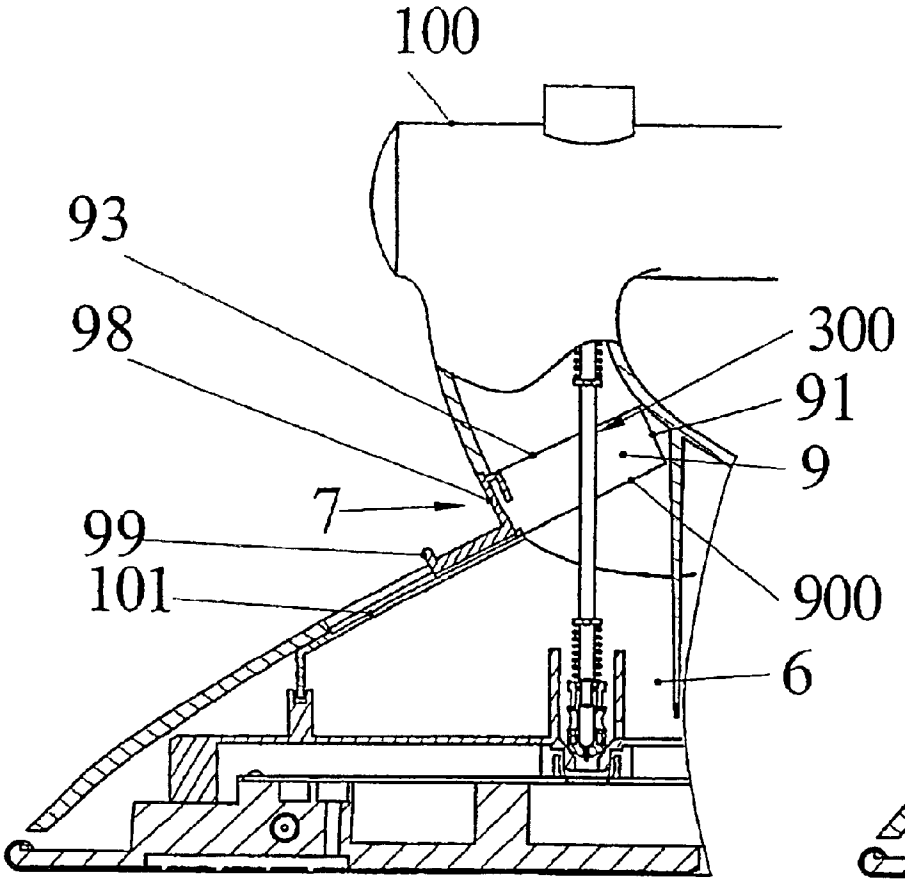
FIG. 6 is a partial view in partial cross-section through a longitudinal plane of the iron of FIG. 4, the means for receiving and guiding the liquid being in a second closed position.

Iron 100 has a water reservoir 6 visible in FIGS. 6 and 7 with a filling orifice 7.

Orifice 7 is traversed by an elongated piece in the form of a U constituting three lateral faces of a slide valve 9, occupying the entire cross-section of orifice 7. This piece in the form of a U is preferably a rigid elastomer. End face 91 of slide valve 9, between the ends of the branches of the U, is open to the interior of reservoir 6.

Figure 5:
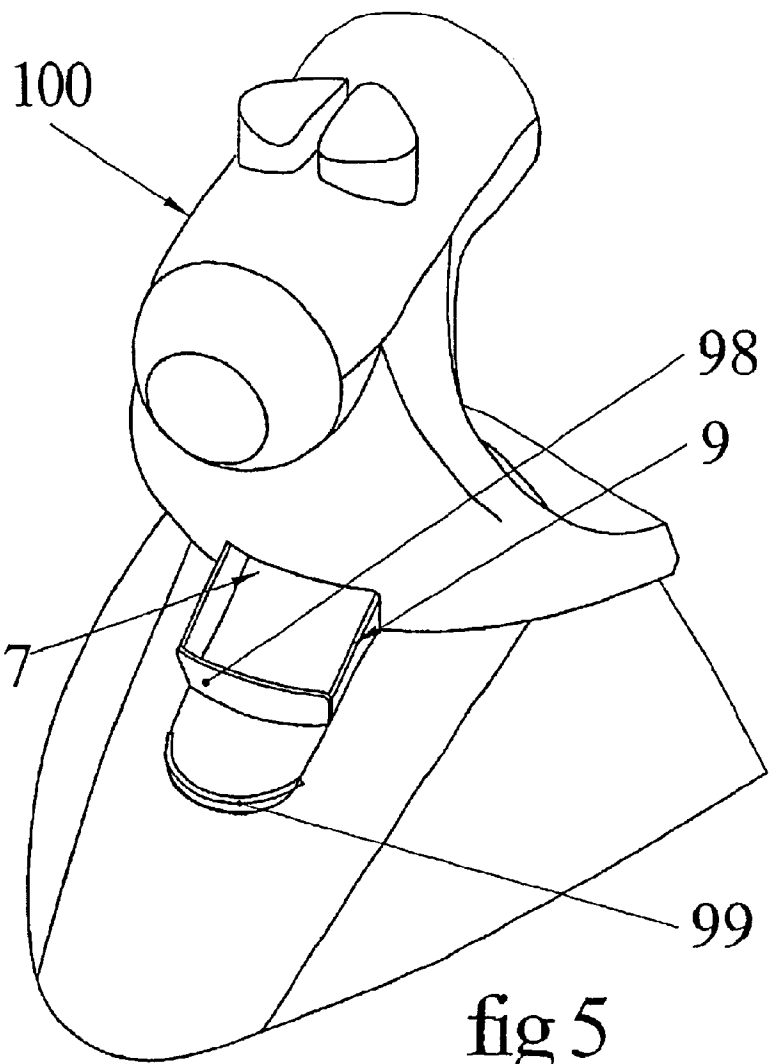
FIG. 5 is a partial view in perspective of the front of the iron of FIG. 4, the means for receiving and guiding the liquid being in a first open position.
Figure 4:
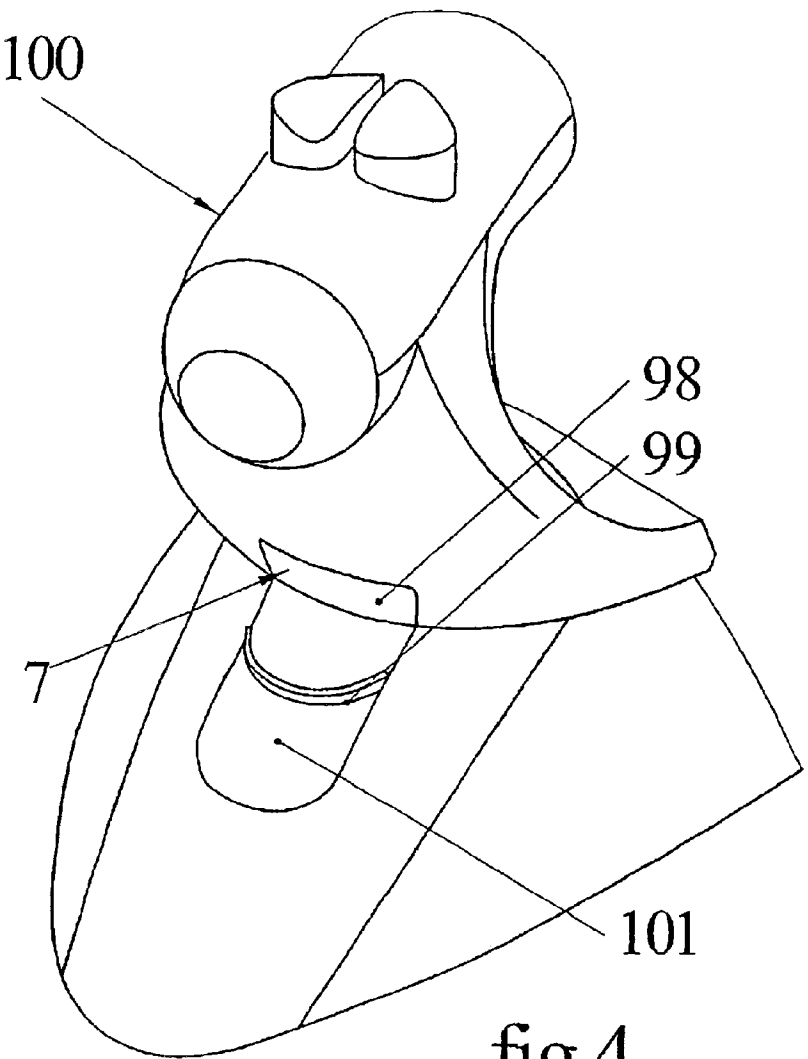
FIG. 4 is a partial view in perspective of the front of another iron according to the invention, the means for receiving and guiding the liquid being in a second closed position.

Slide valve 9 can slide along its longitudinal axis in orifice 7 between a first open position represented in FIGS. 5 and 7 and a second closed position visible in FIGS. 4 and 6. In this movement, the piece in the form of a U remains in contact with an outer wall 101 of iron 100 by one of its edges 900 forming a sealing lip, the other edge delimiting, with the orifice, a filling opening surface 93 larger than orifice 7, directed toward the front of the iron and toward the top.

The slide valve is maintained in the first open position by gentle friction of elastomer lip 900 on wall 101. This wall 101 forms the bottom of slide valve 9, of which the piece in the form of a U forms the lateral faces. Opening 93 is then accessible from outside the iron. A passage is arranged from the outside of the iron toward reservoir 6 through opening 93, slide valve 9 and end face 91.

In the second closed position, slide valve 9 is retracted into the iron. The solid end wall 98 of the U-shaped piece of slide valve 9 then assures closing of orifice 7. The elastomer edges assure sealing of the closure. Due to the U-shaped form, slide valve 9 occupies little space at the interior of the iron. Organs such as a control rod 300 can be found between the branches of the U without interfering with the movement of the slide valve. The structure and ergonomics of the iron are improved thereby.

Advantageously, wall 98 carries forms 99 that permit gripping of the U-shaped piece of slide valve 9 by the user, and its displacement from one position to the other.

During ironing, iron 100 is used with slide valve 9 retracted. Water contained in the reservoir cannot flow out and splash through hermetically closed orifice 7. A small vent not shown is arranged between the reservoir and the atmosphere to prevent a low pressure from appearing in the reservoir. This small vent can be a small calibrated hole disposed toward the front of the iron on end wall 98.

When the user wants to fill reservoir 6, she opens slide valve 9 and inclines the iron, in lifting the tip, to place it in the filling position, slide valve 9 being inclined toward the reservoir. The drip device, situated at the front of the reservoir when the iron is flat, cannot be supplied. Opening 93 is then accessible from above and can receive filling water supplied for example by a cup or by a stream of water from a faucet.

Water flows from opening 93 along slide valve 9 and through orifice 7 and leaves the slide valve by its open inner face 91 from where it fills reservoir 6.

Opening 93 has a cross-section larger than the cross-section of orifice 7, which facilitates filling. The design of a slide valve with a bottomless piece in the form of a U permits, during fabrication of the iron, reducing the space occupied by this organ and disposing adjacent organs with a greater latitude.

Figure 9:
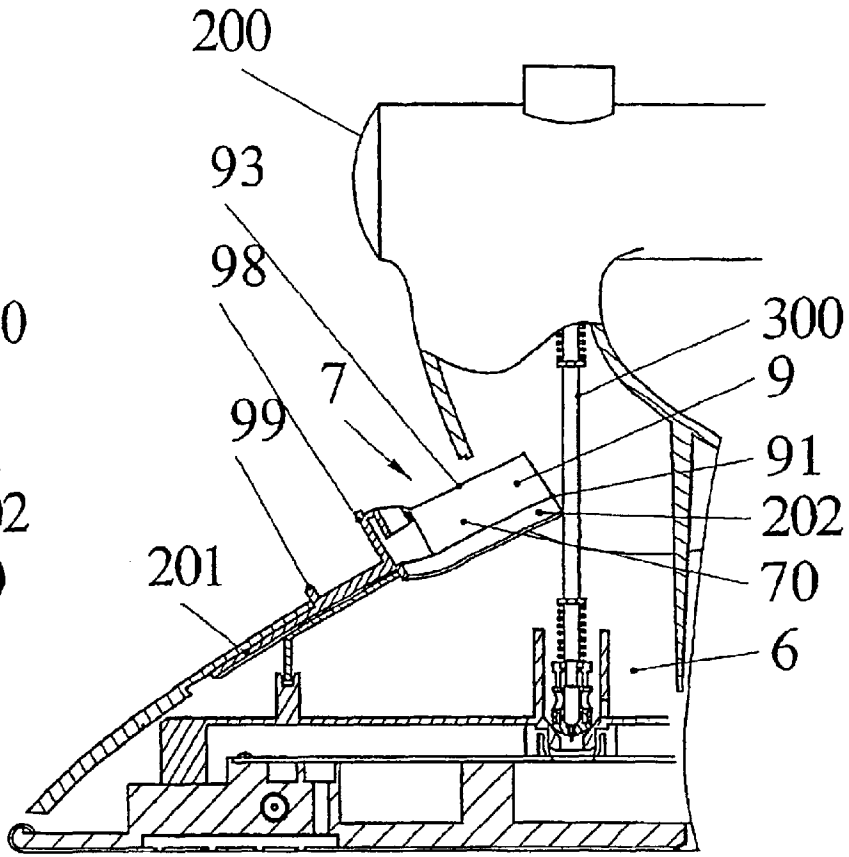
FIG. 9 is a partial view in partial cross-section through a longitudinal plane of the iron of FIG. 8, the means for receiving and guiding the liquid being in a first open position.
Figure 8:
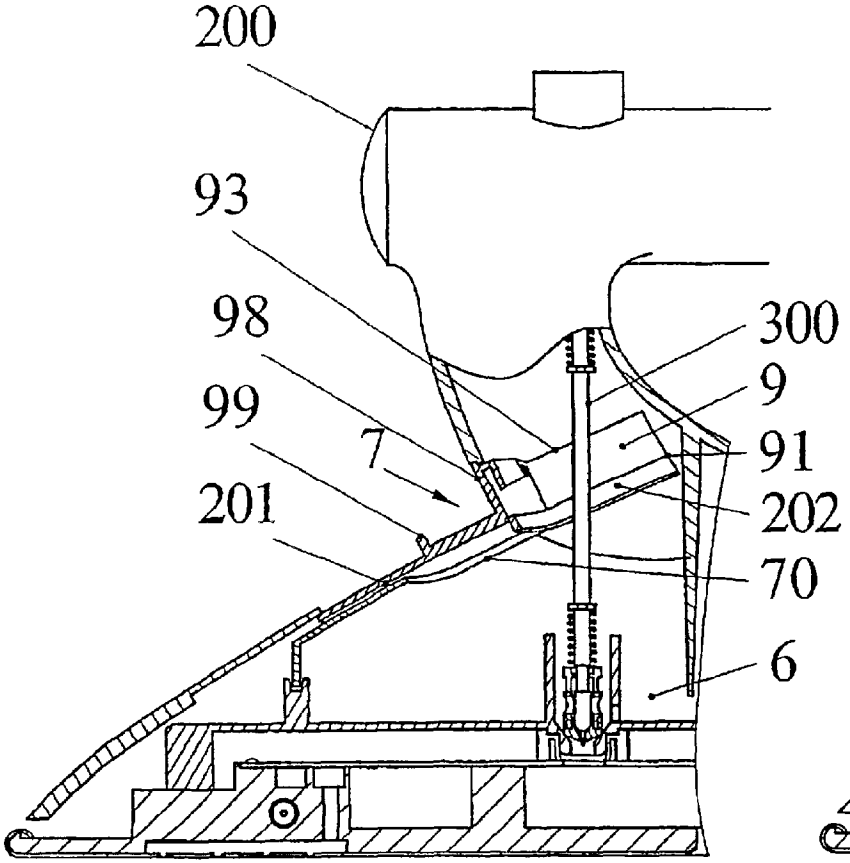
FIG. 8 is a partial view in partial cross-section through a longitudinal plane of another iron according to the invention, the means for receiving and guiding the liquid being in a second closed position.

In a third version of the invention visible in FIGS. 8 and 9, an iron 200 is equipped with water filling means similar to those of the second version. These means also have U-shaped piece forming three lateral faces of a slide valve 9, but filling orifice 7 is extended in the direction of reference 70 along a sliding and bearing plane of slide valve 9. Solid end face 98 of slide valve 9 carries other than maneuvering means 99, a cover 201 that moves with slide valve 9.

In a first open position shown in FIG. 9, slide valve 9 leaves a direct and maximum passage for water toward reservoir 6 between the branches of the U-shaped piece. Usefully the U-shape piece carries a skirt 202 that guides water into part 70 of orifice 7.

In a second closed position, shown in FIG. 8, face 98 of the U-shaped piece closes one part of orifice 7, while cover 201 covers part 70 of the orifice, which is found in the sliding surface of slide valve 9.

Utilization of this version is identical to that of the second. It is preferable when the space available permits housing of a cover.

As can be seen, these means permit optimization of the structure of the iron and facilitate filling with complete safety.

What is claimed is:

1. Pressing iron (1), composed of a liquid reservoir (6) having a filling orifice (7), characterized in that said orifice (7) is furnished with means (9) for receiving and guiding the liquid through the orifice (7) toward the reservoir (6), said means passing through the orifice (7) and being movable in translation between a first open position where the liquid can be introduced, and a second closed position where said means are retracted into the iron (1) and assure closing of the orifice (7).

2. Pressing iron according to claim 1 characterized in that the means for receiving and guiding the liquid comprise an elongated slide valve (9), having an opening (93) on one longitudinal face to receive the liquid, and open at its inner end (91) to permit flow of the liquid.

3. Pressing iron according to claim 1 characterized in that the means for receiving and guiding liquid comprise a U-shaped piece constituting three lateral faces of an elongated slide valve (9), the forth lateral face being an inner end (91) open in to the reservoir (6), a large face constituting a filling opening (93).

4. Pressing iron according to claim 3 characterized in that the elongated slide valve (9) slides on a solid part (101) of the iron which constitutes a fixed bottom for the movable slide valve (9).

5. Pressing iron according to claim 4 characterized in that the piece in the form of a U of the slide valve has a lip (900) assuring a basic sealing with the fixed bottom (101).

6. Pressing iron according to claim 5 characterized in that the piece in the form of a U is made of elastomer and forms a single piece with the joints assuring sealing with the fixed bottom and closing the orifice.

7. Pressing iron according to claim 2 characterized in that the elongated slide valve (9) has a transverse cross section corresponding substantially to the filling orifice (7), and is permanently engaged to slide in said orifice.

8. Pressing iron according to claim 2 characterized in that in the second closed position, the opening (93) is completely retracted into the reservoir.

9. Pressing iron according to claim 2 characterized in that in the first open position, the opening (93) is oriented in a manner to be directed upwardly when the iron (1) is placed on its heel.

10. Pressing iron according to claim 2 characterized in that, in said second closed position, the iron being utilized on its working surface, the slide valve (9) is immersed in the water of the reservoir, and brakes the movements of water in the reservoir.

11. Pressing iron according to claim 2 characterized in that the elongated slide valve (9) has a solid outer end face (98) provided with means for maneuvering the elongated slide valve (9).

12. Pressing iron according to claim 1 characterized in that the orifice (7) has a longitudinal axis and the means (9) for receiving and guiding the liquid are movable in translation along the longitudinal axis.

* * * * *